US006707040B2

(12) United States Patent
Makarov et al.

(10) Patent No.: US 6,707,040 B2
(45) Date of Patent: Mar. 16, 2004

(54) IONIZATION APPARATUS AND METHOD FOR MASS SPECTROMETER SYSTEM

(75) Inventors: Alexander A. Makarov, Cheadle Hulme (GB); Pavel V. Bondarenko, Thousand Oaks, CA (US)

(73) Assignee: Thermofinnigan LLC, San Jose, CA (US)

( * ) Notice: Subject to any disclaimer, the term of this patent is extended or adjusted under 35 U.S.C. 154(b) by 0 days.

(21) Appl. No.: 10/341,621

(22) Filed: Jan. 13, 2003

(65) Prior Publication Data

US 2003/0178563 A1 Sep. 25, 2003

Related U.S. Application Data

(63) Continuation-in-part of application No. 10/105,172, filed on Mar. 21, 2002.

(51) Int. Cl.[7] ..... H01J 49/10

(52) U.S. Cl. ..... 250/288

(58) Field of Search ..... 250/288, 281, 250/282

(56) References Cited

U.S. PATENT DOCUMENTS 5,965,884 A * 10/1999 Laiko et al. ..... 250/288
6,331,702 B1 * 12/2001 Krutchinsky et al. ..... 250/288
6,444,980 B1 * 9/2002 Kawato et al. ..... 250/288
6,624,409 B1 * 9/2003 Mordehai et al. ..... 250/288

* cited by examiner

*Primary Examiner*—Kiet T. Nguyen
(74) *Attorney, Agent, or Firm*—Dorsey & Whitney LLP

(57) ABSTRACT

An ionization apparatus for connection to a mass analyzer is provided. The ionization apparatus comprises a sample slide provided with at least two channels having inner surface having samples deposited thereon, means for delivering energy such as a laser to one of the channels to release and ionize the sample to form ions, and an interfacial orifice for collecting the ions formed in the channel.

23 Claims, 10 Drawing Sheets

IONIZATION APPARATUS AND METHOD FOR MASS SPECTROMETER SYSTEM

RELATED APPLICATIONS

This application is a continuation-in-part of the U.S. patent application Ser. No. 10/105,172, filed Mar. 21, 2002, entitled "Ionization Apparatus and Method for Mass-spectrometer System".

FIELD OF THE INVENTION

This invention relates generally to the field of mass spectrometry, and more particularly to sample ionization for mass spectrometer system. More particularly, this invention relates to an ionization apparatus and method for connection to a mass analyzer to improve mass analysis by seamlessly combining sample ionization and sample analysis.

BACKGROUND OF THE INVENTION

Mass analysis of any sample in a mass spectrometer requires sample ionization as a first step. Sample ionization can be performed under either vacuum or atmospheric pressure. Vacuum ionization techniques include electron impact ionization, fast ion bombardment, secondary ion ionization, and matrix-assisted laser deposition/ionization. Vacuum ionization occurs inside a mass spectrometer instrument under vacuum conditions. A disadvantage of vacuum ionizations is that a sample support must be inconveniently introduced into the vacuum via vacuum locks, making the linking of mass spectrometry with chromatographic and electrophoretic separation methods difficult.

Atmospheric pressure ionization takes place outside of the low pressure components of a mass spectrometer instrument. To sample atmospheric pressure ions, a mass spectrometer must be equipped with an atmospheric pressure interface (API) to transfer ions from an atmospheric pressure region to the mass analyzer under high vacuum. Atmospheric pressure ionization techniques include atmospheric pressure chemical ionization and electrospray ionization (ESI) among others. One problem of many prior art atmospheric pressure ionization techniques is the low transmission efficiency of sample ions to a mass analyzer due to ion losses and low throughput of ions for mass analysis due to non-seamless connection of atmospheric sample ionization and sample analysis under high vacuum.

U.S. Pat. No. 5,663,561 describes a device and method for ionizing analyte molecules at atmospheric pressure by chemical ionization. According to this method, the analyte molecules deposited together with a decomposable matrix material are first decomposed in the surrounding gas under atmospheric pressure to produce neutral gas-phase analyte molecules. Then these neutral gas-phase analyte molecules are ionized by atmospheric pressure chemical ionization. This method requires that the desorption of the analyte be carried out as a separate step from the ionization of the analyte.

U.S. Pat. No. 5,965,884 describes an atmospheric pressure matrix assisted laser desorption ionization (AP-MALDI) ion source. The AP-MALDI apparatus contains an atmospheric pressure ionization chamber hosting a sample to be analyzed, a laser system outside the ionization chamber, and an interface that connects the ionization chamber to the spectrometer. While this AP-MALDI apparatus combines analyte desorption and ionization in a single step, it cannot be operated at an optimum pressure regime, and ion transmission from the ionization chamber to the spectrometer is low. Moreover, analyte adducting is high and undesired molecular clusters are formed during the ionization process.

EP 0964427 A2 describes a MALDI ion source operating at pressures greater than 0.1 torr. While the claimed ion source may be operated at a greater pressure range, it has the same problems as U.S. Pat. No. 5,965,884: low ion transmission, high adducting among analytes and other molecules and undesired cluster formation.

WO 99/38185 and U.S. Pat. No. 6,331,702 B1 describe a spectrometer provided with a pulsed ion source and transmission device to damp ion motion and method of use. This design requires a sample loading chamber or lock chamber and a low pressure MALDI ion source, and has limited throughput.

WO 00/77822 A2 describes a MALDI ion source that is enclosed in a chamber and operated under a low pressure and has a limited throughput.

U.S. Pat. No. 6,331,702 B1 describes a MALDI ion source that is disposed in a vacuum chamber and has a limited throughput.

OBJECTS AND SUMMARY OF THE INVENTION

Accordingly it is an object of the present invention to provide an ionization apparatus for connecting to a mass analyzer to seamlessly combine sample ionization and sample analysis.

It is another object of the present invention to provide an ionization apparatus for fast sample scanning to increase throughput of mass analysis.

It is a further object of the present invention to provide an ionization apparatus which allows sample preparation at atmospheric pressure to increase reliability and reduce construction cost of mass analysis systems.

In accordance with the invention, there is provided an ionization apparatus for connection to a mass analyzer. The ionization apparatus comprises a sample slide having at least two sample spots containing analytes to be analyzed by a mass analyzer, means for delivering energy to one of the sample spots to release and ionize the sample analytes to form sample ions, and an interface for supplying the sample ions to the mass analyzer. The interface comprises a chamber having an orifice in close proximity to the irradiated sample spot and defining a first region encompassing the irradiated sample spot. An ion guide is disposed in the chamber and leads to the mass analyzer in a second region. Means for sustaining a pressure substantially lower than atmospheric within the first region is provided for capturing the ions while other sample spots are maintained at atmospheric pressure. Means for sustaining a pressure within the second region substantially lower than the pressure within the first region is provided.

The means for delivering energy is disposed such that the energy irradiates one of the sample spot through the orifice in front of the irradiated sample spot. Alternatively, the means for delivering energy is disposed such that the energy irradiates one of the sample spots from the back of a transparent sample slide.

The ionization apparatus may comprise a motorized stage for moving the sample slide to sequentially present sample spots to the first region. The motorized stage can be computer controlled and moveable in three dimensions. The sample slide is preferably disposed in proximity of about from 50 to 100 microns to the interface.

The ionization apparatus may comprise a cover slide that seamlessly takes place of the sample slide with the same proximity to the orifice when the sample slide moves away during sample change.

The means for sustaining a pressure substantially lower than atmospheric within the first region can maintain a pressure from few torr to few tens torr. The means for sustaining a pressure within the second region can maintain a pressure from about 0.001 to about 0.1 torr.

In another embodiment of the present invention, there is provided an ionization apparatus further comprising an external groove surrounding the orifice to stabilize the pressure within the first region. This ionization apparatus may further comprise spacing balls for engaging the sample slide and the interface to accurately space the slide from the orifice.

In another aspect of the present invention, there is provided a method for ionizing analytes in a sample for mass spectrometer analysis. The method comprises providing a sample slide having at least two sample spots containing analytes to be analyzed by a mass analyzer and providing an interface connecting one of the sample spots to the analyzer. The interface is provided with a chamber having an orifice in close proximity to one of the sample spots and defining a first region encompassing the sample spot. An ion guide is disposed in the chamber leading to the mass analyzer in a second region. Energy is delivered to one of the sample spots to release and ionize the analytes to form ions. A pressure substantially lower than atmospheric is sustained within the first region while maintaining atmospheric pressure at other sample spots. A pressure within the second region substantially lower than the pressure within the first region is provided.

In another embodiment of the present invention, the ionization apparatus comprises a sample slide that is provided with at least two channels therethrough. Samples are deposited on the inner surfaces of the channels. Means for delivering energy such as a laser irradiates the sample in one of the channels and ionizes the sample to form ions. An interfacial orifice is aligned with and in close proximity to the channel and collects ions formed in the channel. Preferably the sample slide is provided with a plurality of channels, and each channel is sequentially brought in registration with the interfacial orifice by moving the sample slide in three directions. The ionization apparatus may further comprise means for applying a voltage between the sample slide and the orifice for accelerating ion flow. The energy delivery means is disposed such that energy is directed to the samples. The energy delivery means may include a focusing lens aligned with and movable along the axis of the channel to deliver energy to the entire inner surface of the channel. Alternatively, the energy delivery means may include an optical fiber having an end movable along the axis of the channel to deliver energy to the entire inner surface of the channel.

In still another embodiment, the ionization apparatus includes a spacer attached onto the sample slide on the side facing the orifice. The spacer is provided with holes that have the same pattern and dimension as and in registration with the channels in the sample slide. The spacer can be made of electrically non-conductive materials. In operation, the sample slide-spacer assembly can be brought in tight contact with the orifice to increase suction force of gas flow and provide electrical insulation between the sample slide and the orifice.

BRIEF DESCRIPTION OF THE DRAWINGS

The foregoing and other objects of the invention will be more clearly understood from the following description when read in conjunction with the accompanying drawings in which.

DESCRIPTION OF PREFERRED EMBODIMENTS

Figure 1:
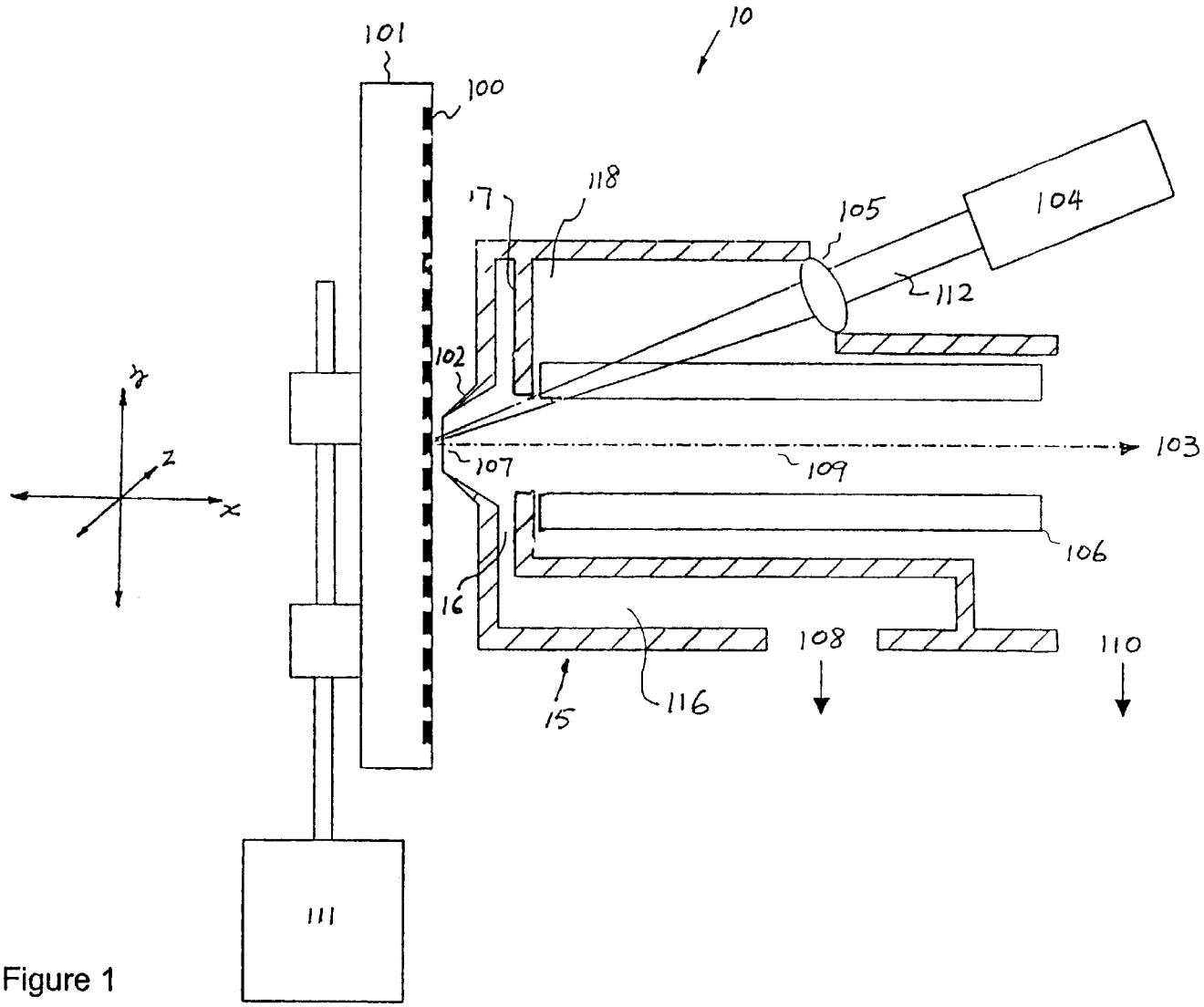
FIG. 1 is a schematic view of an ionization apparatus including a laser source delivering energy to a sample spot through an orifice in front of a sample slide.

FIG. 1 shows an embodiment 10 of an ionization apparatus of the present invention. This ionization apparatus 10 comprises a sample slide 101 having at least two sample spots 100 containing sample analytes to be ionized, a laser source 104 for delivering energy 112 to one of the sample spots 100 through a focus lens 105. The energy 112 ionizes the sample at the irradiated sample spot 100. An interface 15 collects ions generated at the irradiated sample spot 100 and delivers them to a mass analyzer (not shown) as indicated by arrow 103. The mass analyzer 103 can comprise a time of flight (TOF) mass analyzer, an ion trap mass analyzer, an orbitrap mass analyzer, a magnetic sector mass analyzer, or a Fourier transform mass analyzer.

The sample slide 101 is maintained at atmospheric pressure and brought in close proximity to the interface 15 by a motorized stage 111. The motorized stage 111 is computer controlled and movable in three dimensions (x, y, z). A plurality of sample spots 100 are provided on the sample slide 101 so that they are brought sequentially into position for ionization and analysis. Each individual sample spot 100 is brought sequentially in registration with the interface 15 by driving the motorized stage 111 controlled by a computer (not shown). Materials that can be used for the sample slide 101 include electrically conductive metals such as stainless steel, insulating polymers such as teflon, and porous silica. It is apparent that the sample can be deposited together with a decomposable matrix material at the sample spot 100 and the sample slide can be moved in the x-y-z directions to bring the spot in registration with the orifice 102 of the interface 15. A cover slide (not shown) seamlessly takes place of the sample slide with the same proximity to the orifice during sample change.

The walls of interface 15 form a chamber 118 having an orifice 102 which captures ions generated at the irradiated sample spot 100. An ion guide 106 is disposed in the chamber 118 to transport ions to the mass analyzer as indicated by arrow 103. Preferably, the orifice 102 is in the shape of a truncated cone and is brought into a close proximity to the sample slide 101 so that the irradiated sample spot 100 is located opposite the opening of the cone. The distance between the irradiated sample spot 100 and the front surface of the orifice 102 can be precisely controlled by moving the motorized stage 111 in the x direction. Preferably, the distance is within from about 50 to 100 microns. A wall 17 is spaced from the end of the interface walls to define a subchamber 16 adjacent to the orifice 102. A pump (not shown) is connected to port 108 which communicates with the subchamber to sustain a pressure within the region 107 of the orifice 102 which is higher than the pressure in chamber 118. The pump can be a rotary vacuum pump and sustain a pressure from few torr to few tens torr at the sample spot 100 being ionized. Accordingly, the region surrounding the sample spot 100 being ionized can be sustained a pressure substantially lower than atmospheric while other sample spots 100 outside the region 107 encompassed by the orifice 102 are maintained at atmospheric pressure.

An ion guide 106 is disposed inside the chamber 118 and extends from the orifice 102 to a mass analyzer 103, forming a multipole region 109 through which sample ions are transported by combination of gas flows and electric fields. The ion guide 106 can be any transmission or trapping device. Preferably the ion guide 106 is a RF-only multipole and can be heated. A turbo pump (not shown) is connected to a port 110 for sustaining a vacuum within the chamber 118. A valve (not shown) is also equipped at port 110 so that the pressure within the multipole region 109 can be adjusted from 0.001 to 0.1 torr for optimal performance.

A laser source 104 delivers energy such as a UV light, visible light, or IR light 112 through a lens 105, which focuses the energy on one of the sample spots to release and ionize the sample. The laser source 104 can irradiate pulsed or continuous energy to at least one sample at a time. In this embodiment 10 of the ionization apparatus, the laser source 104 and the lens 105 are disposed such that laser energy 112 is delivered to one of the sample spots 100 through the orifice 102 in front of the sample spot 100.

Figure 2:
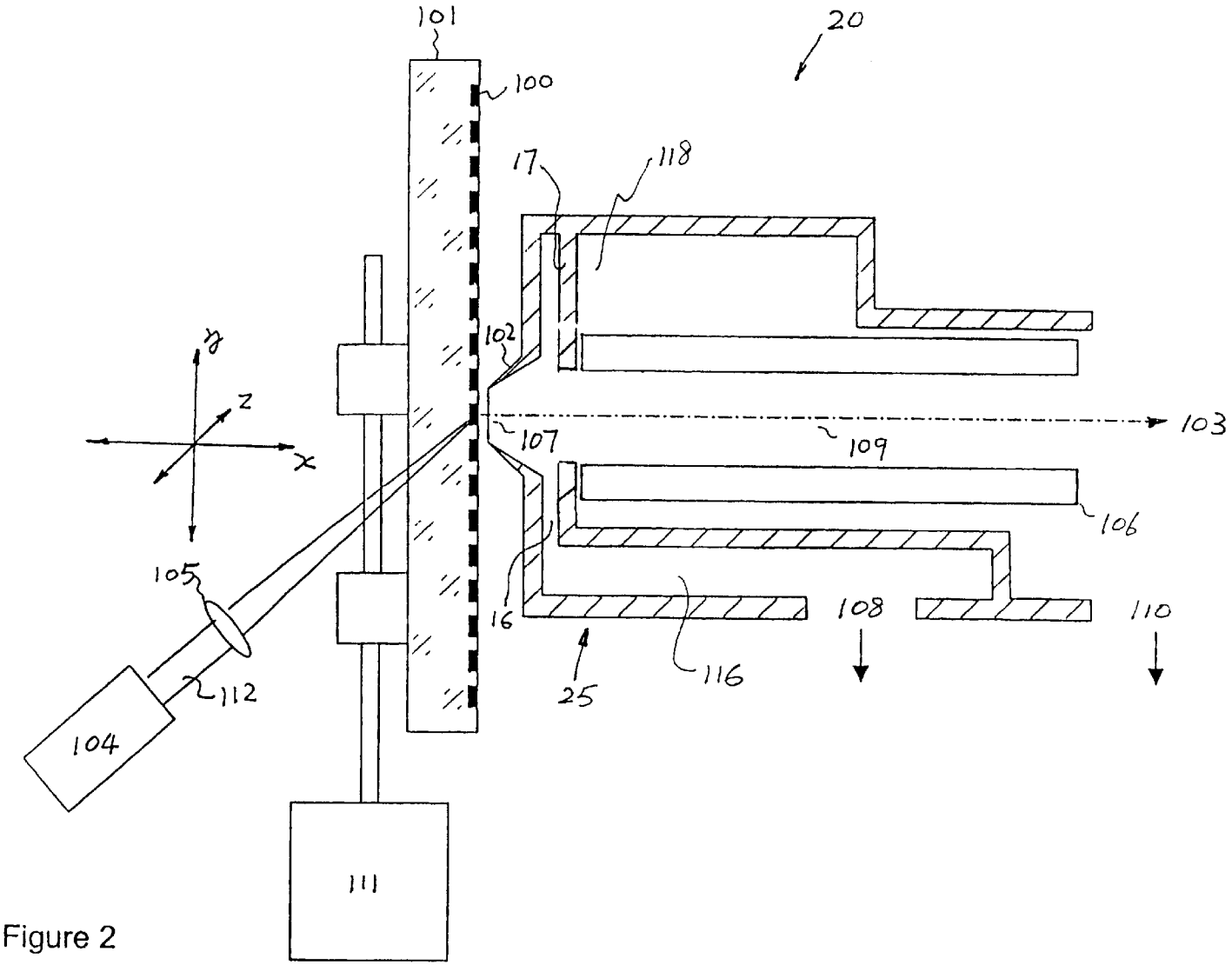
FIG. 2 is a schematic view of an ionization apparatus including a laser source delivering energy to a sample spot from the back of a transparent sample slide.

FIG. 2 shows another embodiment 20 of the ionization apparatus of the present invention. The laser source 104 and the lens 105 are disposed such that the laser energy 112 is delivered to one of the sample spots 100 from the back of the sample slide 101, either through a transparent slide, or the sample can be on the end of a transparent optical fiber. Preferably the sample slide or optical fiber is made of quartz.

Figure 3:
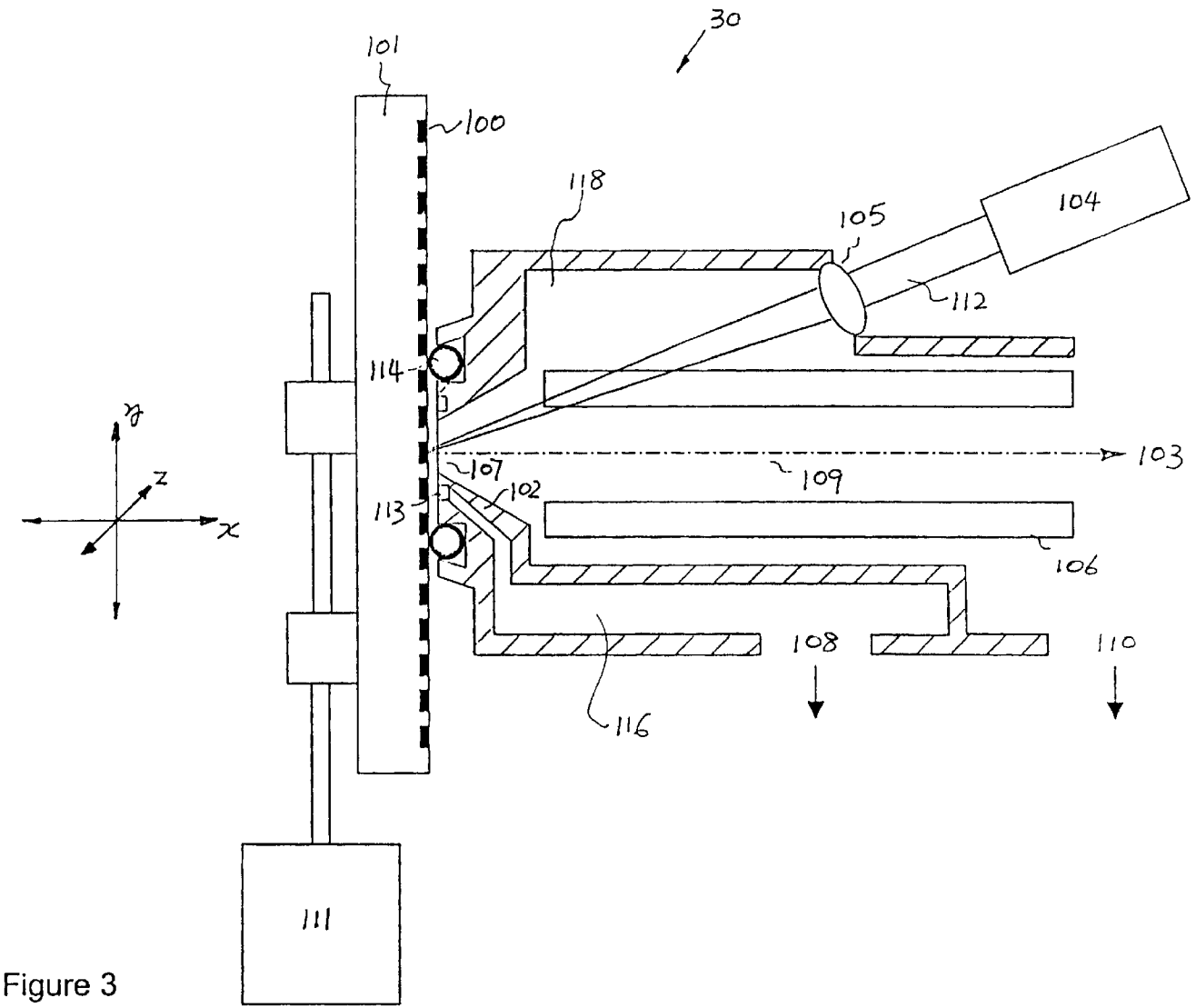
FIG. 3 is a schematic view of an ionization apparatus having an interface including a groove and spacing balls at an orifice in front of the sample slide.

FIG. 3 shows another embodiment 30 of the ionization apparatus of the present invention. In comparison with embodiments 10 and 20, embodiment 30 has an external groove 113 surrounding the orifice at the end of the chamber 118. The groove 113 is evacuated through the chamber passage 116 connected to port 108, preferably by a rotary pump connected to the port 108. This increases robustness of the differential pumping and stability of the pressure in the orifice region 107. To further increase stability of the pressure in the orifice region 107, the gap between the sample slide 101 and the orifice 102 is fixed by introducing spaced ball bearings 114. This design provides a greater precision and accuracy for the gap between the sample slide 101 and orifice 102. The ball size can be chosen large enough, so that the balls roll over the sample spots 100 without reaching the bottoms of the wells 100 in which the samples are located. This embodiment 30 can use either front or back laser irradiation as illustrated in embodiments 10 and 20.

One advantage of the present invention is that sample analysis may be seamlessly combined with sample ionization that makes the system ideal for high-throughput proteomics. Ion losses on the orifice are low. Another advantage is that vacuum seals are not needed between the sample spot being ionized and other spots. The motorized stage moving the sample slide can be operated at atmospheric pressure. This results in higher reliability and lower construction cost of ionization system. Moreover, the present ionization apparatus can increase throughput up to 1 second per sample due to fast sample scanning and no time losses on sample introduction. The ionization system of the present invention is also advantageous in that it is easy to automate and interchangeable with ESI ion source, thus both proteomic tools can be used in parallel for the same sample.

Figure 4:
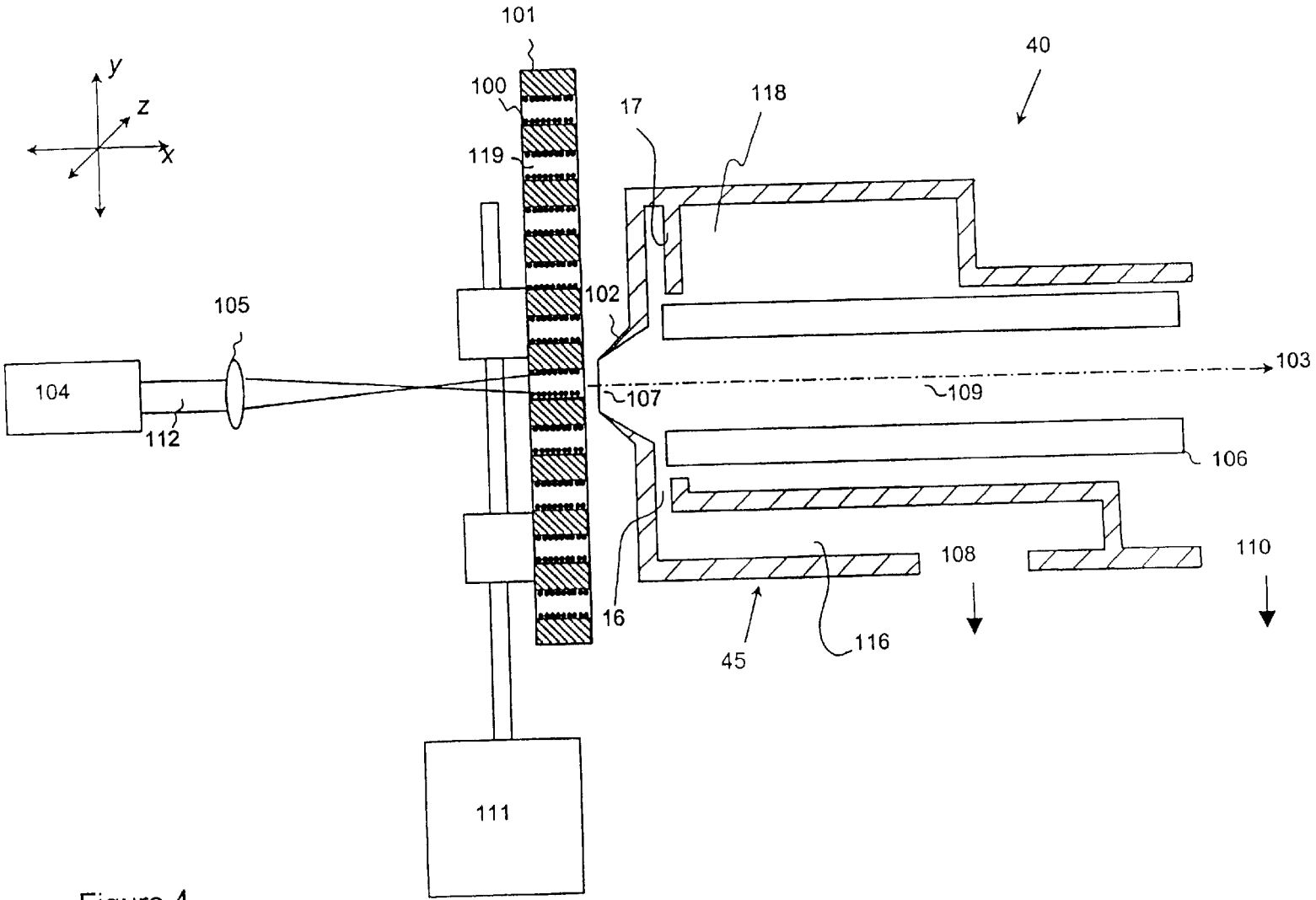
FIG. 4 is a schematic view of an ionization apparatus including a sample slide provided with a plurality of sample channels.

FIG. 4 shows another embodiment 40 of the ionization apparatus of the present invention. In this embodiment 40, the sample slide 101 is provided with at least two channels 119. Samples 100 to be analyzed are deposited on the inner surfaces of the channels 119. Preferably a plurality of channels 119 are provided in the sample slide 101 to increase throughput of mass analysis. The sample slide 101 can be moved in three directions (x-y-z) by the motorized stage 111 controlled by a computer to sequentially bring each channel 119 in registration with the orifice 102. The gap between the sample slide 101 and the orifice 102 is controlled by moving the sample slide 101 in x direction until it is closely adjacent the orifice 102. In operation, one channel is aligned with the orifice 102 and laser energy 112 irradiates sample 100 to form ions which are captured at region 107 and guided to the mass analyzer 103 by combination of electrical field and gas flow. This embodiment 40 is advantageous in that the channels 119 in the sample slide 101 enhance the air-dynamic properties of gas flow and improve ion entrainment at the entrance to the orifice 102.

Figure 5:
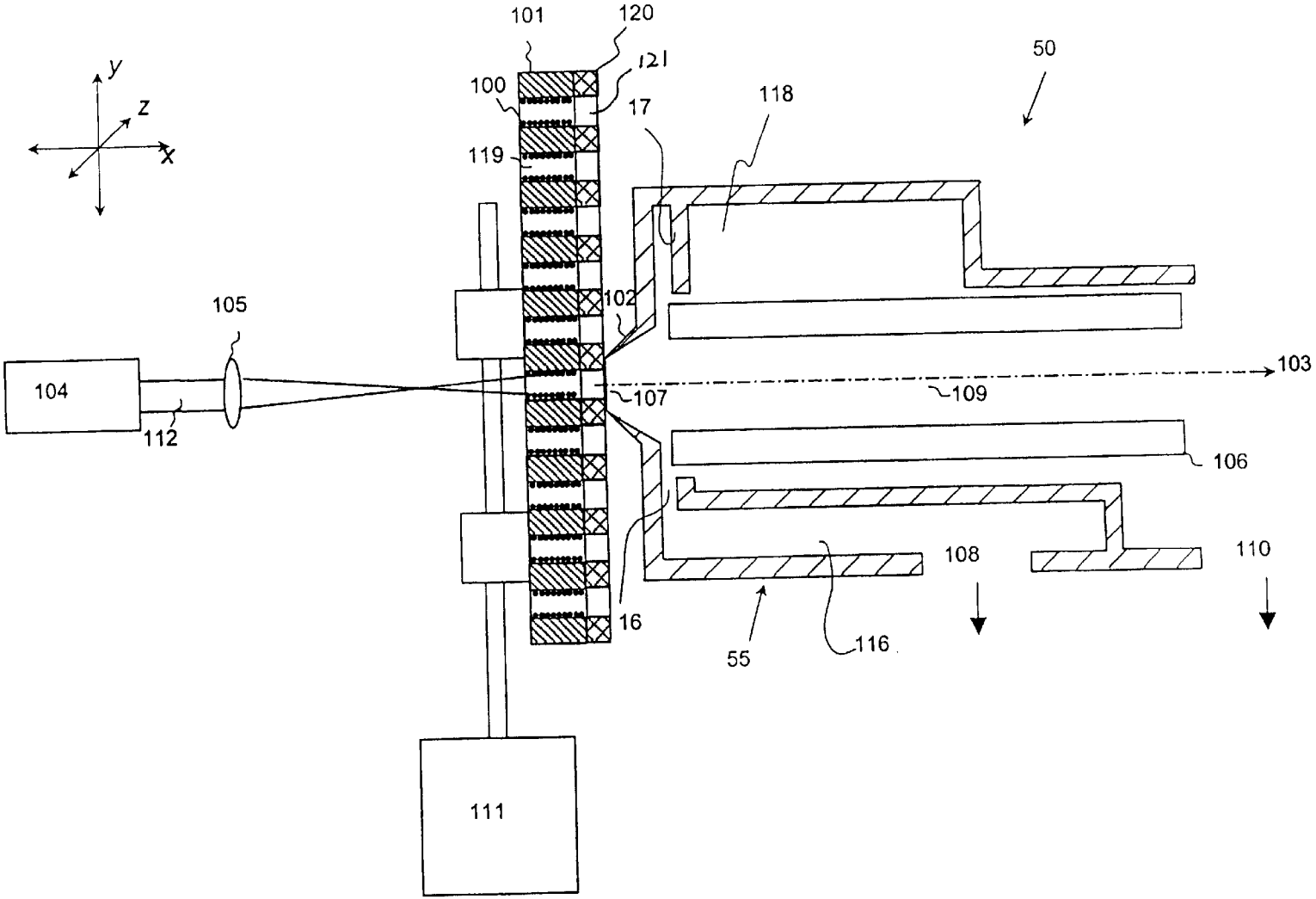
FIG. 5 is a schematic view of an ionization apparatus including a spacer attached to the sample slide illustrated in FIG. 4.

FIG. 5 shows another embodiment 50 of the ionization apparatus of the present invention. In this embodiment 50, a spacer 120 provided with channels or holes 121 is attached to the sample slide 101 on the side that faces the orifice 102. The holes 121 have substantially the same dimensions and patterns as the channels 119 in the sample slide 101. When laser energy 112 irradiates the sample 100 in operation, all three of the channel 119 in the sample slide 101, the hole 121 in the spacer 120, and the orifice 102 are aligned on one axis. The sample slide 101 and spacer 120 assembly can be moved in three directions (x-y-z) by the motorized stage 111 to bring each channel 119 and hole 121 in registration with the orifice 102. Preferably the sample slide and spacer assembly is brought in tight contact with the orifice 102 and slides across the orifice 102. This embodiment 50 is advantageous in that the spacer 120 increases suction force of gas flow through the channel 119 to the orifice 102 and reproducibility of sample positioning with respect to the orifice 102. The spacer 120 also provides electrical insulation between the sample slide 120 and the orifice 102 when a voltage is applied. In addition, the spacer protects orifice 102 from sample carryover and prevents sample cross contamination.

In the embodiments 40 and 50 of the present ionization apparatus illustrated in FIGS. 4 and 5, the laser source 104 and lens 105 are disposed such that laser energy 112 is delivered to one of the channels 119 from the back of the sample slide 101. Alternatively, the laser source 104 can be disposed such that laser energy 112 is delivered to one of the channels 119 through the orifice 102 in front of the channel 119, as illustrated in FIGS. 2 and 3.

More detail structure of embodiments 40 and 50 of the ionization apparatus of the present invention are now described with reference to FIGS. 6 to 14.

Figure 6:
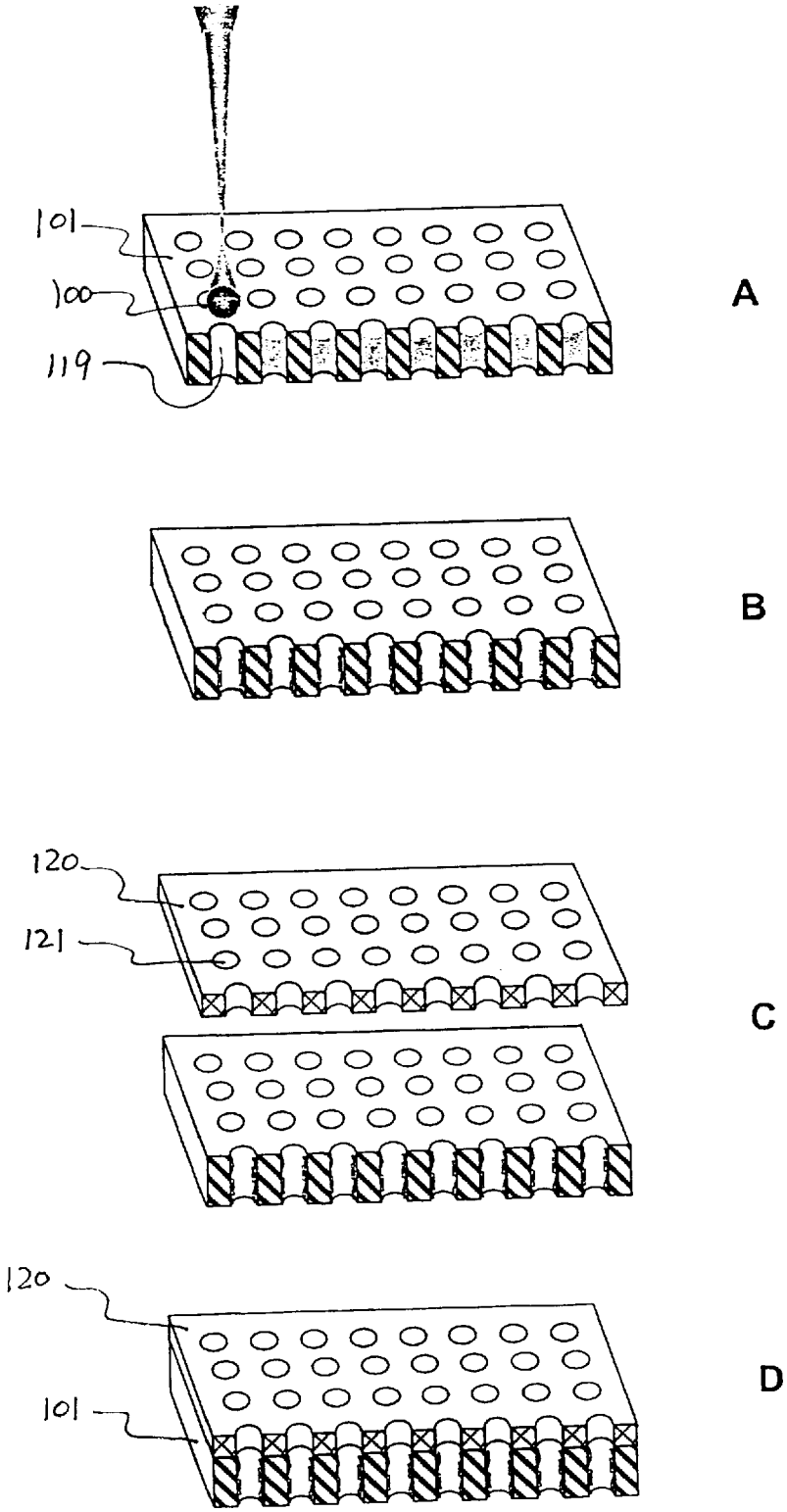
FIG. 6 is an exploded view illustrating depositing samples into channels in a sample slide and attaching a spacer to the sample slide.

FIG. 6 schematically shows channels 119 in sample slide 101 and deposition of samples 100 in the channels 119. While FIG. 6 shows the channels 119 in shape of a cylinder for illustration purpose, other shapes of channel can also be used as long as they increase gas flow in the channels and improve ion entrainment at the orifice. For example, the channels can also be shaped in a truncated cone. The channels 119 can be fabricated in an array on one plate 101 to enhance throughput of sample deposition. The prior art methods of depositing samples on a flat surface can be used in depositing samples 100 in the channels 119. For instance, the samples 100 can be mixed with an MALDI matrix and deposited in the channels 119 using known deposition protocols and robots. The samples 100 are sucked inside the channels 119 by capillary force. For example, a channel having a diameter of 0.65 mm and a length of 3 mm can accommodate 1.0 $\mu$l of samples. After drying for a few minutes, only solid residue remains in the channels 119. In the embodiment where a spacer 120 is attached onto the sample slide 101 as illustrated in FIG. 5, the sample slide 101 provided with an array of channels 119 can be covered by an electrically insulating plate or spacer 120. The electrical insulating plate 120 is provided with a plurality of holes 121 that are of the same dimension and pattern as the channels 119 in the sample slide 101. The holes 121 in the insulating plate 120 are in registration with the channels 119 in the sample slide 101. The insulating plate 120 can be made from electrically nonconductive materials, such as glass, teflon, and plastic. Preferably the insulating plate 120 has smooth surfaces for tight attachment to the sample slide and better sliding across the orifice 102. The insulating plate or spacer 120 provides electrical insulation between the sample slide 101 and orifice 102 and also protects the orifice 102 from cross contamination from different samples. The sample slide and spacer assembly so prepared can be stored in an autosampler waiting for analysis. After analysis, the sample slide 101 and spacer 120 can be washed and reused.

The channels 119 in the sample slide 101 preferably have a diameter that is substantially same as or similar to the diameter of the orifice 102 at the interface, preferably ranging from about 0.2 mm to 2 mm. The length of the channels 119 can be several millimeter, preferably ranging from 0.5 mm to 20 mm. Preferably, a plurality of channels 119 are provided in the sample slide 101 to increase analysis throughput. In operation, each individual channel 119 is sequentially brought in registration with the orifice 102 for ionization and analysis. The distance between the sample slide 101 and the orifice 102 is preferably within from about 50 to 100 microns for easy access of laser radiation to sample 100 and efficient collection of ions. In the embodiment where a spacer 120 is attached to the sample slide 101 as illustrated in FIG. 5, the sample slide 101 and spacer 120 assembly is preferably brought in tight contact with the orifice 102. Any gap between the spacer 120 and the orifice 102 is defined by the surface roughness and tolerances of the spacer 120 and orifice 102, and is much smaller than the diameter of the channel 119, allowing the main gas stream flows through the channel 119.

Figure 7:
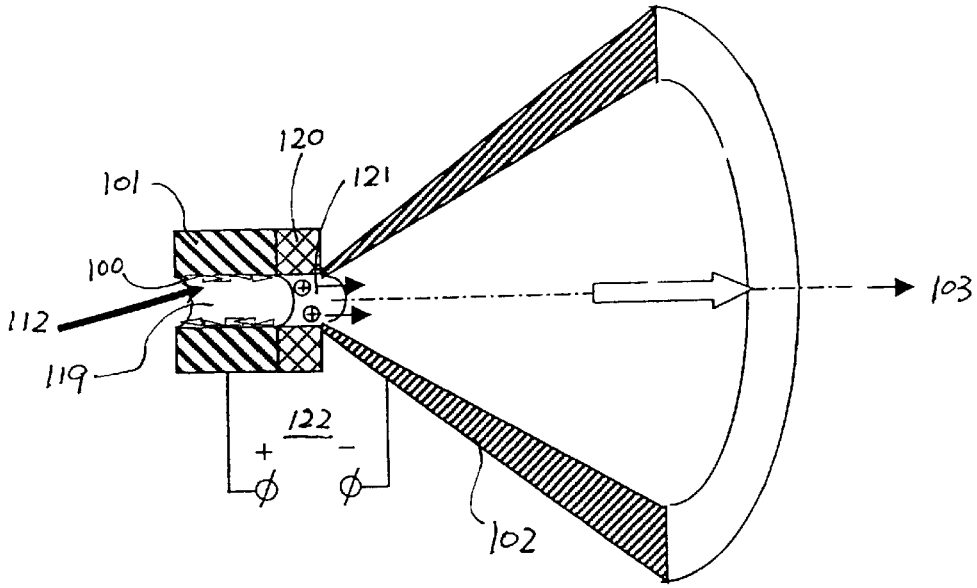
FIG. 7 is a partial sectional view of an ionization apparatus illustrating an orifice in form of a truncated cone in contact with a spacer attached to a sample slide provided with channels.
Figure 8:
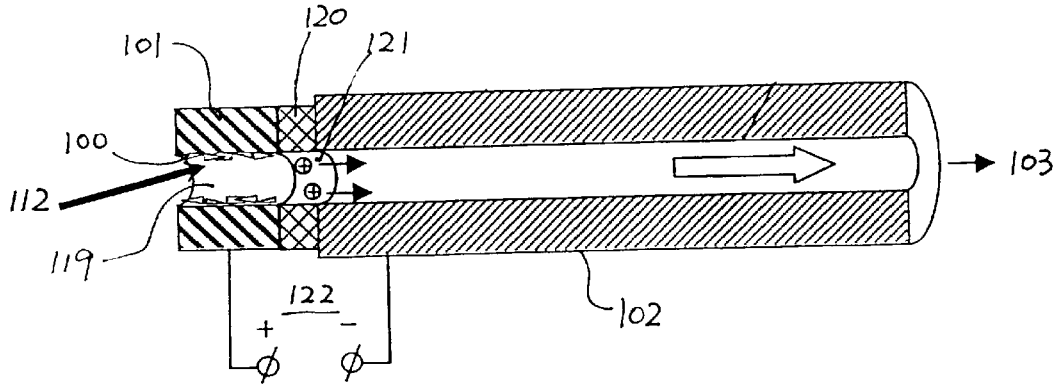
FIG. 8 is a partial sectional view of an ionization apparatus illustrating an orifice in form of a tube in contact with a spacer attached to a sample slide provided with channels.
Figure 9:
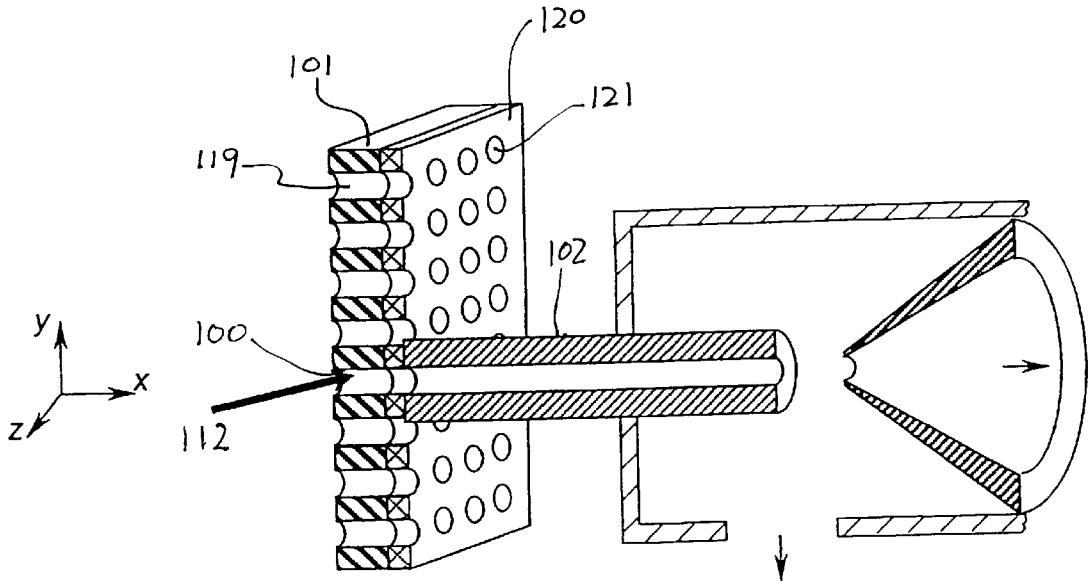
FIGS. 9 and 10 are partial sectional views of ionization apparatus illustrating that energy beam irradiates samples in a channel at an angle with respect to the axis of the channel.
Figure 10:
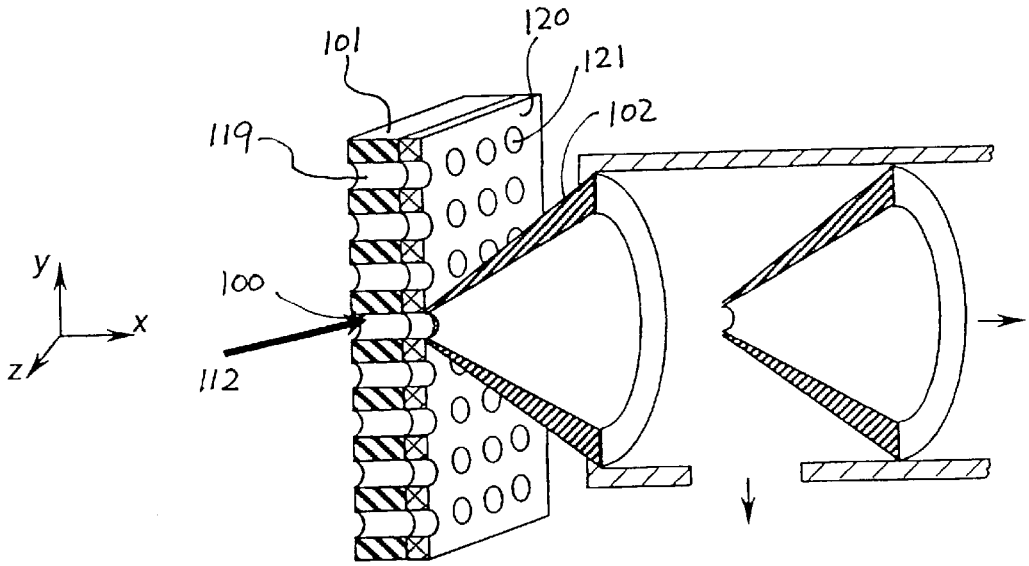
Figure 11:
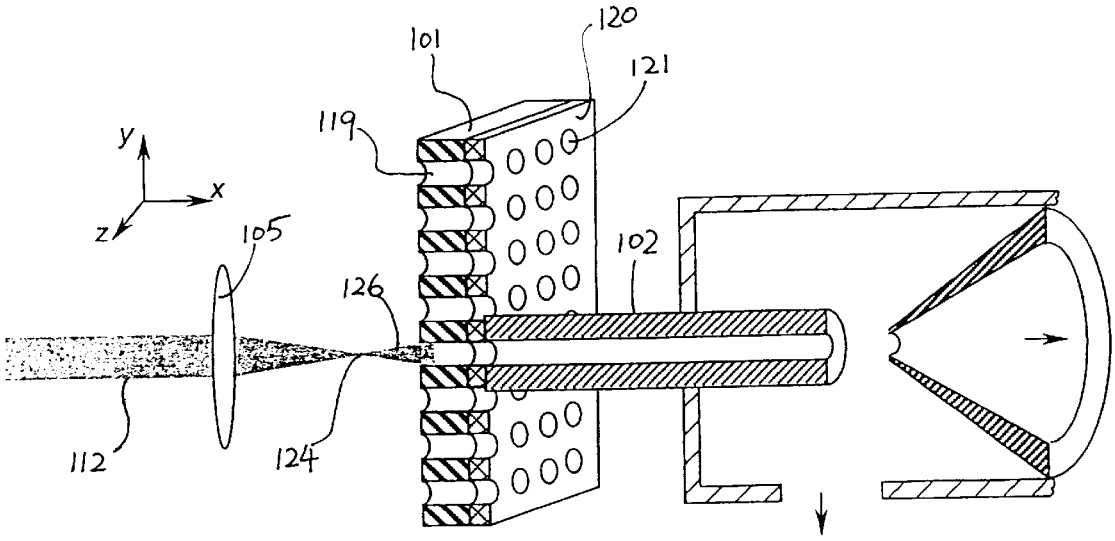
FIGS. 11 and 12 are partial sectional views of ionization apparatus comprising a focus lens movable along the axis of the channel.
Figure 12:
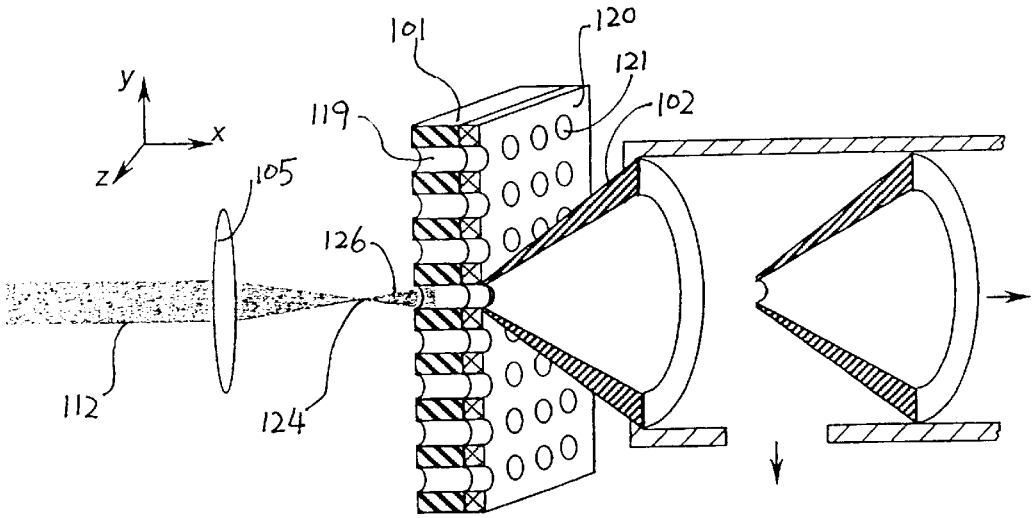
Figure 13:
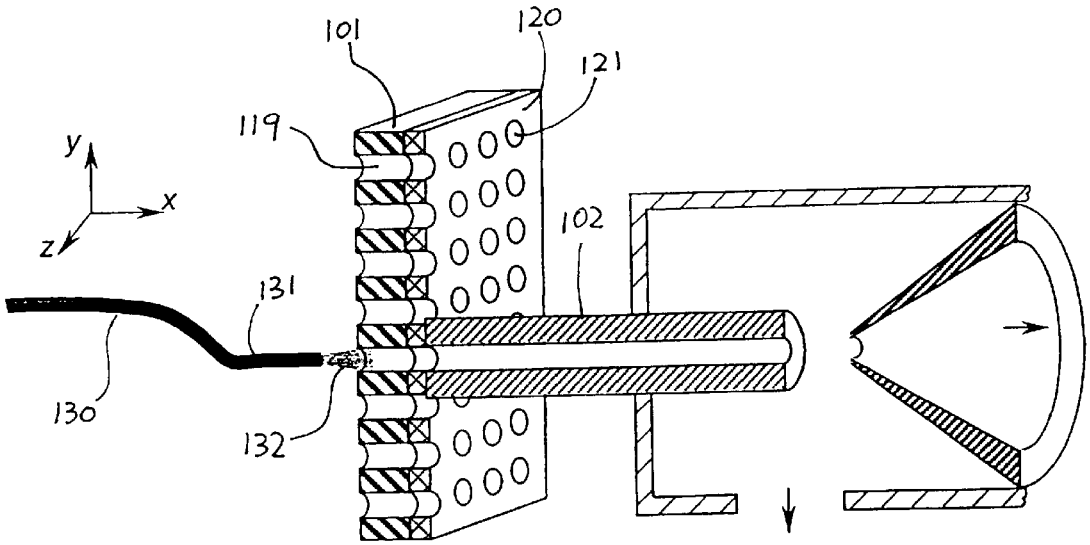
FIGS. 13 and 14 are partial sectional views of ionization apparatus comprising an optical fiber having an end movable along the axis of the channel.
Figure 14:
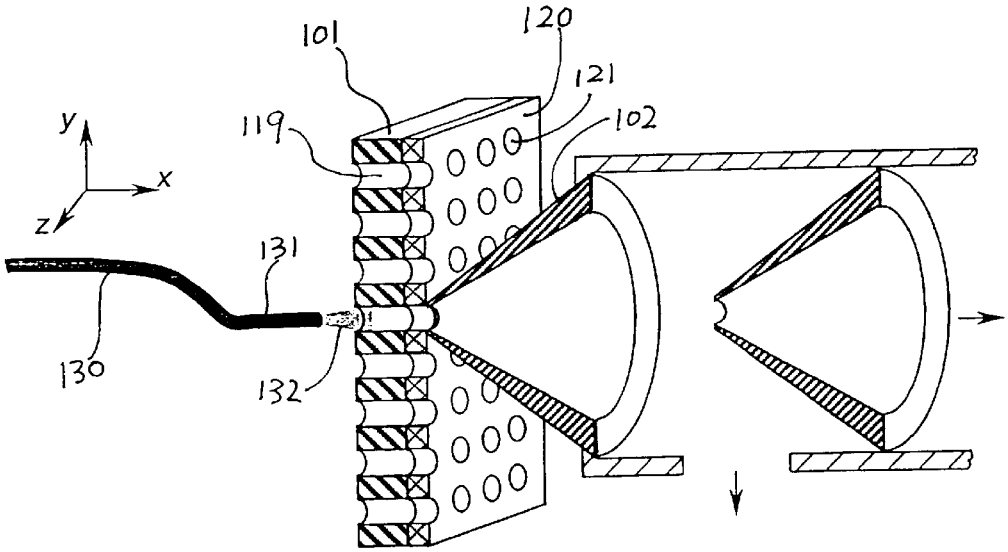

FIGS. 7 and 8 schematically show the orifice 102 that is in alignment with an individual channel 119. In FIGS. 7 and 8, an insulating spacer 120 is disposed between the channel 119 and the orifice 102. Though the sample slide 101 and spacer assembly is shown as in contact with the orifice 102, this is not required. A small gap between the orifice 102 and sample slide 101 allows a faster sample changeover and therefore improve throughput of analysis. In the embodiment where spacer is not used as shown in FIG. 4, the gap between the sample slide 101 and the orifice 102 is preferably controlled within 50 to 100 microns for better access for laser irradiation of samples and better gas flow and ion entrainment at the entrance to the orifice 102.

The orifice 102 can be in form of a skimmer as shown in FIG. 7, or a tube as shown in FIG. 8. In both embodiments of skimmer and tube, the orifice 102 has a diameter substantially same as the diameter of the channel 119 in the sample slide 101, or the hole 121 in the spacer 120, at the interface between the orifice 102 and the channel 119 or the hole 121. Preferably the diameter of the orifice 102 at the interface is from 0.2 mm to 2 mm.

To facilitate gas flow of ions formed in the channel 119 to the orifice 102, and eventually to the mass analyzer 103 through an ion guide, the pressure in the channel 119 can be controlled. In the embodiment of a skimmer orifice 102 as shown in FIG. 7, the pressure in the channel 119 is preferably maintained from a few Torr to a few tenths of Torr. In the embodiment of a tube orifice 102 as shown in FIG. 8, the pressure in the channel 119 is preferably maintained from below atmosphere to 10 Torr. In one embodiment, a voltage 122 is applied between the channel 119 and the orifice 102 to facilitate gas flow of ions, as shown in FIGS. 7 and 8. Ions of one polarity are accelerated towards the orifice 102 by electrical field, while ions of opposite polarity are prevented from entering the orifice 102 by the voltage 122.

FIGS. 9 to 14 illustrate various means for delivering energy to the channel 119 to release and ionize samples 100. To better irradiate samples 100 on the inner surface of the channel 119, the laser beam 112 is preferably non-parallel to the axis of the channel 119. In one embodiment illustrated in FIGS. 9 and 10, the laser beam 112 irradiates the sample 100 at a small angle with respect to the axis of the channel 119. Preferably the angle ranges from 5 to 85 degrees with respect to the axis of the channel 119. In another embodiment illustrated in FIGS. 11 and 12, a focus lens 105 is used where the laser beam 112, the focus lens 105, and the channel 119 are aligned on one axis. The laser beam 112 is focused in a focal point 124 in front of the channel 119. Modern nitrogen lasers can be focused in a spot of 0.1 mm in diameter. After the focal point 124, divergent beam 126 irradiates entire channel 119. To reach deeper into the channel 119, the focusing lens 105 is preferably movable along the axis of the channel 119 in x direction. In another embodiment illustrated in FIGS. 13 and 14, an optical fiber 130 is used to create a symmetrical, divergent laser beam 132 with point source in front of the channel 119. To reach deeper into the channel 119, the end 131 of the optical fiber 130 is preferably movable along the axis of the channel 119 in x direction.

One advantage of the ionization apparatus comprising a sample slide provided with channels is that during sample preparation steps, the channels can be used for fraction collection from HPCL, for automatic sample deposition by an autosampler, for mixing sample and MALDI matrix solutions, and for sample purification and affinity separation.

The foregoing description of specific embodiments and examples of the invention have been presented for the purpose of illustration and description, they are not intended to be exhaustive or to limit the invention to the precise forms disclosed. Obviously many modifications, embodiments, and variations are possible in light of the above teaching. It is intended that the scope of the invention encompass the generic area as herein disclosed, and by the claims appended hereto and their equivalents.

What is claimed is:

1. An ionization apparatus for connection to a mass analyzer, comprising:

a sample slide, said sample slide being provided with at least two channels having inner surfaces having samples deposited thereon;

means for delivering energy to one of the channels to ionize the samples to form ions; and an interface connecting said one of the channels to said analyzer, said interface comprising an orifice aligned with and in close proximity to said one of the channels for collecting ions.

2. The ionization apparatus of claim 1 wherein said channels are in shape of a cylinder or truncated cone.

3. The ionization apparatus of claim 1 wherein the length of the channels ranges from 0.5 to 20 millimeters.

4. The ionization apparatus of claim 1 further comprising a motorized stage to move said sample slide in three dimensions (x, y, z).

5. The ionization apparatus of claim 4 wherein said sample slide is provided with a plurality of channels, and each channel is sequentially brought in registration with the orifice by moving the sample slide in three dimensions.

6. The ionization apparatus of claim 1 further comprising means for applying a voltage between the sample slide and the orifice.

7. The ionization apparatus of claim 1 wherein the means for delivering energy is disposed such that energy is directed to the samples at an angle ranging from 5 to 85 degrees with respect to the axis of said one of the channels.

8. The ionization apparatus of claim 1 wherein said means for delivering energy includes a focusing lens aligned with and movable along the axis of said one of the channels to radiate energy to the entire inner surface of said one of the channels.

9. The ionization apparatus of claim 1 wherein said means for delivering energy includes an optical fiber having an end movable along the axis of said one of the channels to radiate energy to the entire inner surface of the channel.

10. The ionization apparatus of claim 1 wherein said orifice is in shape of a skimmer or tube.

11. The ionization apparatus of claim 1 wherein said orifice has a diameter substantially same as the diameter of said one of the channels at the interface between the orifice and said one of the channels.

12. The ionization apparatus of claim 1 further comprising means for maintaining pressure within said one of the channels.

13. The ionization apparatus of claim 12 wherein the pressure maintained in said one of the channels ranges from 10 Torr to below atmospheric pressure.

14. The ionization apparatus of claim 1 further comprising a spacer attached to the sample slide, said spacer being provided with holes in registration with the channels in the sample slide.

15. The ionization apparatus of claim 14 wherein the holes in the spacer have a diameter substantially same as the diameter of said one of the channels at the interface between the spacer and the sample slide.

16. The ionization apparatus of claim 14 wherein said spacer is made of electrically non-conductive materials.

17. The ionization apparatus of claim 14 wherein said spacer is in contact with said orifice in operation.

18. A method of ionizing a sample for mass analysis, comprising:

providing a sample slide provided with at least two channels, said channels having inner surfaces having samples deposited thereon;

delivering energy to one of the channels to ionize said samples to form ions; and collecting the ions using an orifice.

19. The method of claim 18 wherein the step of delivering energy includes delivering energy to the samples on the inner surface at an angle ranging from 5 to 85 degree with respect to the axis of the channels.

20. The method of claim 18 wherein the step of delivering energy includes delivering energy to the entire inner surface of said one of the channels.

21. The method of claim 18 further comprising applying a voltage between the channel and the orifice to accelerate gas flow of ions.

22. The method of claim 18 further comprising providing electrical insulation between the channel and the orifice.

23. The method of claim 18 wherein an electrical insulation is provided by attaching a spacer between the sample slide and the orifice.

* * * * *